US009926925B2

(12) United States Patent
Wanstrom et al.

(10) Patent No.: US 9,926,925 B2
(45) Date of Patent: Mar. 27, 2018

(54) SLUDGE FLOW MEASURING SYSTEM

(71) Applicant: Schwing Bioset, Inc., Somerset, WI (US)

(72) Inventors: Charles M. Wanstrom, Maplewood, MN (US); Thomas M. Anderson, Naples, FL (US); Shahzad M. Khan, Little Canada, MN (US); Michael M. Mott, Hudson, WI (US)

(73) Assignee: Schwing Bioset, Inc., Somerset, WI (US)

( * ) Notice: Subject to any disclaimer, the term of this patent is extended or adjusted under 35 U.S.C. 154(b) by 562 days.

(21) Appl. No.: 14/477,288

(22) Filed: Sep. 4, 2014

(65) Prior Publication Data

US 2016/0069343 A1 Mar. 10, 2016

(51) Int. Cl.

| | |
|---|---|
| ***F04B 15/02*** | (2006.01) |
| ***F04B 51/00*** | (2006.01) |
| ***F04B 15/00*** | (2006.01) |

(52) U.S. Cl.

CPC ..... *F04B 51/00* (2013.01); *F04B 15/00* (2013.01); *F04B 15/02* (2013.01); *F04B 2201/0201* (2013.01); *F04B 2201/0202* (2013.01)

(58) Field of Classification Search

CPC ..... F04B 15/02; F04B 2201/0201; F04B 2201/0202; F04B 2201/0206; F04B 2201/0209; Y10S 417/90

See application file for complete search history.

(56) References Cited

U.S. PATENT DOCUMENTS

| | | | | |
|---|---|---|---|---|
| 5,106,272 | A * | 4/1992 | Oakley | F04B 15/02 417/347 |
| 5,257,912 | A * | 11/1993 | Oakley | F04B 15/02 417/347 |
| 5,330,327 | A | 7/1994 | Anderson | |
| 5,332,366 | A * | 7/1994 | Anderson | F04B 15/02 417/53 |
| 5,336,055 | A | 8/1994 | Anderson | |
| 5,346,368 | A | 9/1994 | Oakley et al. | |
| RE35,473 | E | 3/1997 | Oakley et al. | |
| 5,839,883 | A * | 11/1998 | Schmidt | F04B 15/023 417/63 |
| 6,929,454 | B2 * | 8/2005 | Munzenmaier | F04B 15/023 417/342 |
| 7,611,331 | B2 * | 11/2009 | Hoefling | F04B 7/0241 417/12 |
| 7,611,332 | B2 * | 11/2009 | Hofmann | F04B 15/02 417/26 |
| 8,899,819 | B2 * | 12/2014 | Alden | G05B 19/0428 366/16 |

* cited by examiner

*Primary Examiner* — Patrick Hamo
(74) *Attorney, Agent, or Firm* — Kinney & Lange, P.A.

(57) ABSTRACT

A sludge flow monitoring system and method measures volume of sludge pumped by a positive displacement pump through a pipeline by determining a fill percentage during each pumping cycle. The start and end of each piston stroke are identified by hydraulic system sensors. The fill percentage is determined based upon a first summation of periodic piston speed command values from the start of a pumping stroke to the end of a pumping stroke, and a second summation of periodic piston speed command values from a poppet valve opening indicating output flow from the pump to the end of the pumping stroke.

19 Claims, 6 Drawing Sheets

SLUDGE FLOW MEASURING SYSTEM

BACKGROUND

The present invention relates to systems for transporting high solid sludge (which includes slurries and mixtures of organic or inorganic solids, liquids, and gases such as air). In particular, the present invention relates to sludge flow measuring systems used in conjunction with a positive displacement pump to measure and monitor flow of sludge by determining a fill percentage during each pumping stroke.

Sludge flow monitoring systems were introduced in the early 1990's, and have been the subject of a number of patents, including U.S. Pat. No. 5,106,272 (reissued as Reissue 35,473), entitled "Sludge Flow Measuring System"; U.S. Pat. No. 5,257,912, entitled "Sludge Flow Measuring System"; U.S. Pat. No. 5,336,055, entitled "Closed Loop Sludge Flow Control System"; U.S. Pat. No. 5,330,327, entitled "Transfer Tube Material Flow Management"; and U.S. Pat. No. 5,346,368, entitled "Sludge Flow Measuring System".

Sludge flow measuring systems have defined a standard for measurement of the volume of material delivered by a sludge pump through a pipeline. Some applications, however, require even greater accuracy than has been available in the past from sludge flow monitoring systems. High accuracy would be of great importance to the user in those cases where compensation is based upon the actual volume of material that has been pumped.

SUMMARY

A sludge flow monitoring system and method makes use of hydraulic system sensors to define the beginning and end of each pump cycle, while using a signal from a poppet valve sensor to identify when pumping of material from a cylinder begins. The use of hydraulic system sensors, rather than solely the state of the poppet valves, provides greater accuracy to the beginning and end of each pump cycle.

The sludge flow measurement is achieved by use summations of periodic piston speed command values. Fill efficiency (or percentage) is determined based upon a first summation of periodic piston command speed values from the start of a pumping stroke to the end of the pumping stroke, and a second summation of periodic piston speed command values from the opening of the outlet poppet valve signifying flow of material from the cylinder to the end of the pumping stroke.

DETAILED DESCRIPTION

Figure 1:
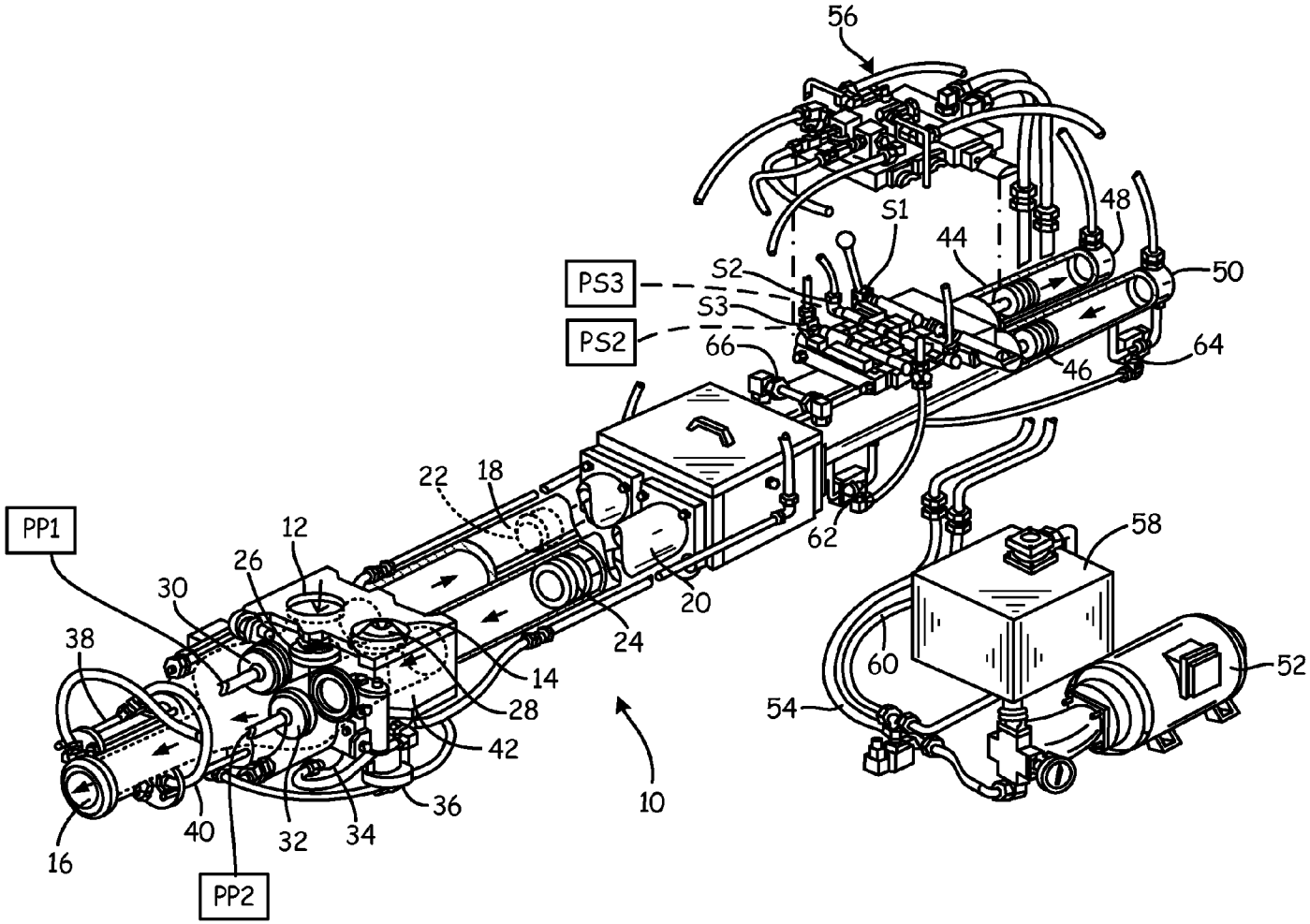
FIG. 1 is a perspective view, with portions broken away and portions exploded, of a sludge pump system which uses inlet and outlet poppet valves.

FIG. 1 shows two cylinder hydraulically driven positive displacement sludge pump 10. High solids sludge material is received at inlets 12 and 14, and is pumped through outlet 16 to a pipeline (not shown). Pump 10 includes a pair of material cylinders 18 and 20 in which a pair of material pistons 22 and 24 reciprocate. Inlet poppet valve 26 controls the flow of sludge from inlet 12 to material cylinder 18. Similarly, inlet poppet valve 28 controls the flow of sludge from inlet 14 to material cylinder 20. The flow of sludge from cylinders 18 and 20 to outlet 16 is controlled by outlet poppet valves 30 and 32, respectively.

Inlet poppet valves 26 and 28 are controlled by hydraulic inlet valve cylinders 34 and 36, respectively. Outlet poppet valves 30 and 32 are controlled by hydraulic outlet valve cylinders 38 and 40.

In the particular position shown in FIG. 1, inlet poppet valve 26 and outlet poppet valve 32 are in an open position. This means that piston 22 is moving away from poppet valve housing 42, while material piston 24 is moving toward poppet valve housing 42. Sludge is being drawn through inlet 12 and into cylinder 18, while sludge is being pumped from cylinder 20 to outlet 16.

Material pistons 22 and 24 are coupled to hydraulic drive pistons 44 and 46, respectively, which move in hydraulic cylinders 48 and 50. Hydraulic fluid is pumped from hydraulic pump 52 through high pressure lines 54 to control valve assembly 56. Assembly 56 includes throttle and check valves which control the sequencing of high and low pressure hydraulic fluid to hydraulic cylinders 48 and 50 and to poppet valve cylinders 34, 36, 38 and 40. Low pressure hydraulic fluid returns to hydraulic reservoir 58 through low pressure line 60 from valve assembly 56. As shown in FIG. 1, assembly 56 includes three valve spools S1-S3.

Forward and rear switching valves 62 and 64 sense the presence of piston 46 at the forward and rear ends of travel and are interconnected to control valve assembly 56. Each time piston 46 reaches the forward or rear end of its travel in cylinder 50, a valve sequence is initiated which results in cycling of all four poppet valves 26, 28, 30, 32 and a reversal of the high pressure and low pressure connections to cylinders 48 and 50.

The sequence of operations of pump 10 is generally as follows: As the drive pistons 44 and 46 and their connected material pistons 22 and 24 come to the end of their stroke, one of the material cylinders (in FIG. 1, cylinder 20) is discharging material to outlet 16, while the other cylinder 18 is loading material from inlet 12. The end of the pumping stroke, material piston 24 is at its closest point to poppet valve housing 42, while piston 22 is at its position furthest from poppet valve housing 42. At this point, switching valve 62 senses that hydraulic drive piston 46 has reached the forward end of its stroke. Valve assembly 56 is activated which causes poppet valve cylinders 40 to close and 36 to open. This causes poppet valve cylinder 34 to close and 38 to open.

At this point, pistons 22 and 24 are at the ends of their stroke, and their direction movement is about to reverse. All four poppet valves 26, 28, 30 and 32 are closed. Hydraulic pressure begins to increase in cylinder 48, which drives piston 44 forward. In turn, piston 22 moves forward toward poppet valve housing 42. Piston 22, therefore, is now in a pumping or discharging stroke. At the same time, hydraulic fluid located forward of piston 44 is being transferred from cylinder 48 through interconnection 66 to the forward end of cylinder 50. This applies hydraulic pressure to piston 46 to move it in a rearward direction. As a result, material piston 24 begins moving away from poppet valve housing 42 and it is in a loading or filling stroke. When the pressure in valve housing 42 below poppet valve 28 essentially equals the pressure on the inlet side, poppet valve 28 opens, which allows sludge to flow through inlet 14 and into cylinder 20 during the filling stroke.

As piston 22 begins to move forward, it first compresses the sludge within cylinder 22. At the moment when the compressed sludge equals the pressure of the compressed sludge in the delivery line and at outlet 16, poppet valve 30 opens. Since the poppet valve for the discharging cylinder opens only when the cylinder content pressure essentially equals the pressure in the pipeline, no material can flow back.

The operation continues, with piston 22 moving forward and piston 24 moving rearward until the pistons reach the end of their respective strokes. At that point, switching valve 64 causes valve assembly 56 to close all four poppet valves and reverse the connection of the high and low pressure fluid to cylinders 48 and 50.

The operation continues with one material piston 22, 24 operating in a filling stroke while the other is operating in a pumping or discharge stroke.

FIG. 1 shows a new method of sludge flow measurement incorporating proximity sensors on spools S2 and S3. Using hydraulic cylinder 50 as the cylinder that is pumping material, when piston 46 in the hydraulic cylinder reaches the end of its stroke, an oil signal is sent to spool S3 to shift the poppets through switching valve 62. When proximity sensor PS3 mounted on spool S3 notes that spool S3 has shifted, that signal from sensor PS3 indicates time of completion of the pumping stroke (te). The pressure poppet P2 that just completed its pumping stroke closes, suction valve 28 for the next stroke opens, then pressure builds in the hydraulic system which shifts pool S2. When proximity sensor PS2 on spool S2 indicates the position change of spool S2 that represents the beginning of the next pumping stroke (t0). Then the oil pressure closes suction poppet valve 26 that was open. When the pressure in pumping cylinder 18 is greater than the pipeline pressure, pressure poppet 30 for the current pumping stroke opens and proximity sensor PP1 on poppet valve 30 then records tp.

This method takes some of the delay from the poppet shifting (of poppet valves 30 and 32) out of the fill efficiency calculation that was previously included, and represented an error in the calculation. Times t0, tp, and to will be discussed further, and are shown in conjunction with FIGS. 4A-4C.

Figure 2:
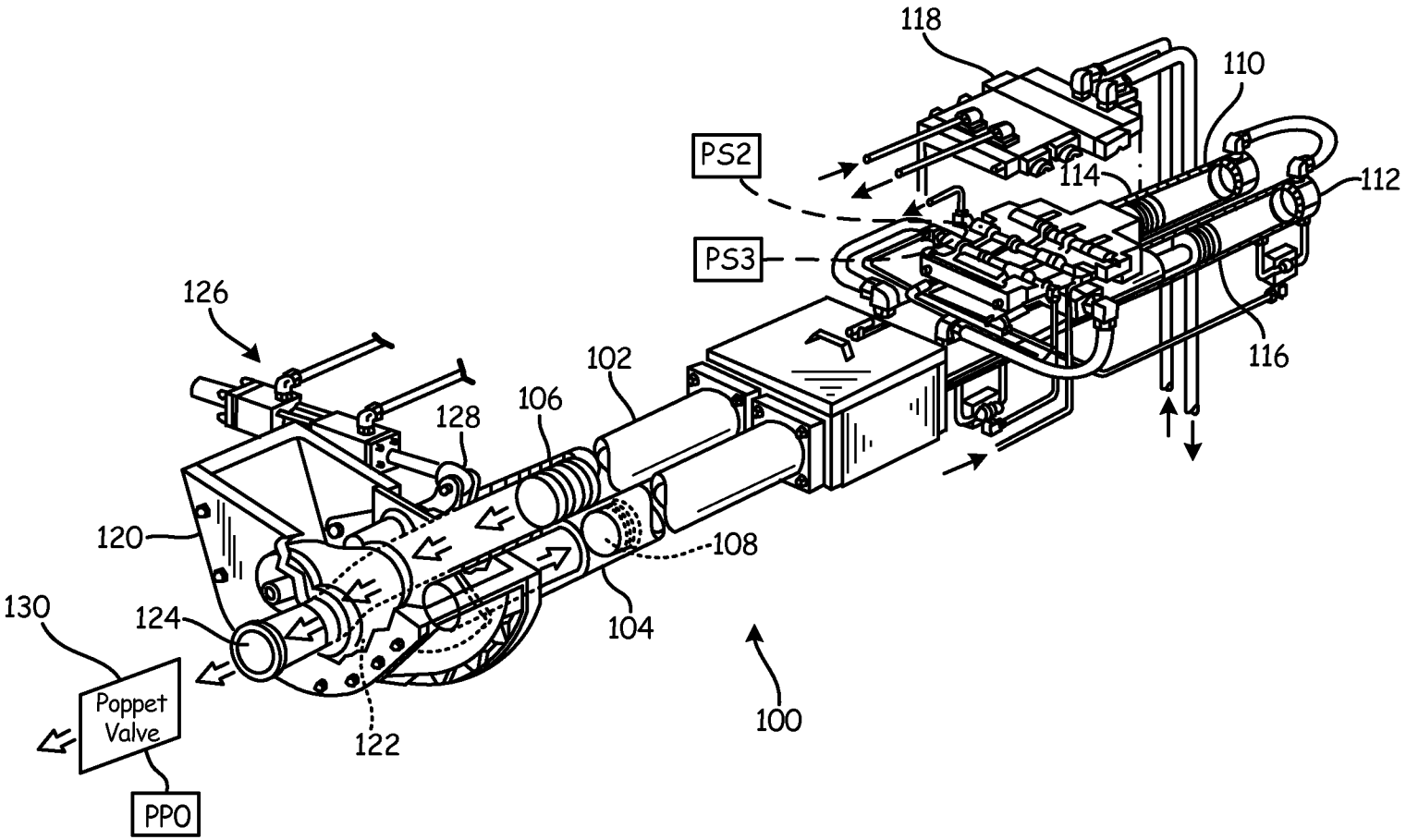
FIG. 2 is a perspective view, with portions broken away and portions exploded, of a portion of a sludge pump having a pivoting transfer tube valve and a single outlet poppet valve.

FIG. 2 shows a perspective view, with portions broken away, of a two cylinder positive displacement sludge pump 100 having a pivoting transfer tube valve, as opposed to the poppet valve arrangement shown in FIG. 1. Pump 100 includes a pair of material cylinders 102 and 104 in which material pistons 106 and 108 reciprocate. Hydraulic drive cylinders 110 and 112 have drive pistons 114 and 116, respectively, which are connected to material pistons 106 and 108, respectively. Valve assembly 118 controls the sequencing of movement of pistons 114 and 116, and thus the movement of pistons 106 and 108 in material cylinders 102 and 104.

Sludge is supplied to hopper 120, in which a pivoting transfer tube 122 is positioned. Transfer tube 122 connects outlet 124 with one of the two material cylinders (in FIG. 2 outlet 124 is connected to cylinder 102), while the inlet to the other material cylinder (in this case cylinder 104) is open to the interior of hopper 120. In FIG. 2, piston 106 is moving forward in a discharge stroke to pump sludge out of cylinder 102 to outlet 124, while piston 108 is moving rearward to draw sludge into cylinder 104.

At the end of a stroke, hydraulic actuators 126 which are connected to pivot arm 128 cause transfer tube 122 to swing so that outlet 124 is now connected to cylinder 104. The direction of movement of pistons 106 and 108 reverses, with piston 108 moving forward in a discharge stroke while piston 106 moves backward in a filling or loading stroke.

Hydraulic fluid to operate the cylinders and the controls of pump 100 is supplied by a hydraulic pump and reservoir assembly (not shown in FIG. 2) which is similar to pump 52 and reservoir 58 shown in FIG. 1.

A primary difference between pump 100 shown in FIG. 2 and pump 10 shown in FIG. 1 is the valve arrangement. In pump 100, one of the two cylinders 102 and 104 is connected to outlet 124 during the entire discharge or pumping stroke. In contrast, in pump 10, outlet poppet valve 30 or 32 opens only when material within the cylinder has compressed to the point at which the outlet pressure and the pressure of material within the material cylinder are equal. As discussed later, the system of the present invention can be used with either pump 10 or pump 100, with some difference in the parameters being sensed to accommodate the differences in operation of the two valve assemblies.

Like the system of FIG. 1, the system of FIG. 2 senses position of spools S2 and S3 with proximity sensors PS2, PS3 to identify the end of one piston stroke and the beginning of the next piston stroke. It also uses poppet valve 130 and proximity sensor PP0 to identify when material is flowing out of a cylinder.

Figure 3:
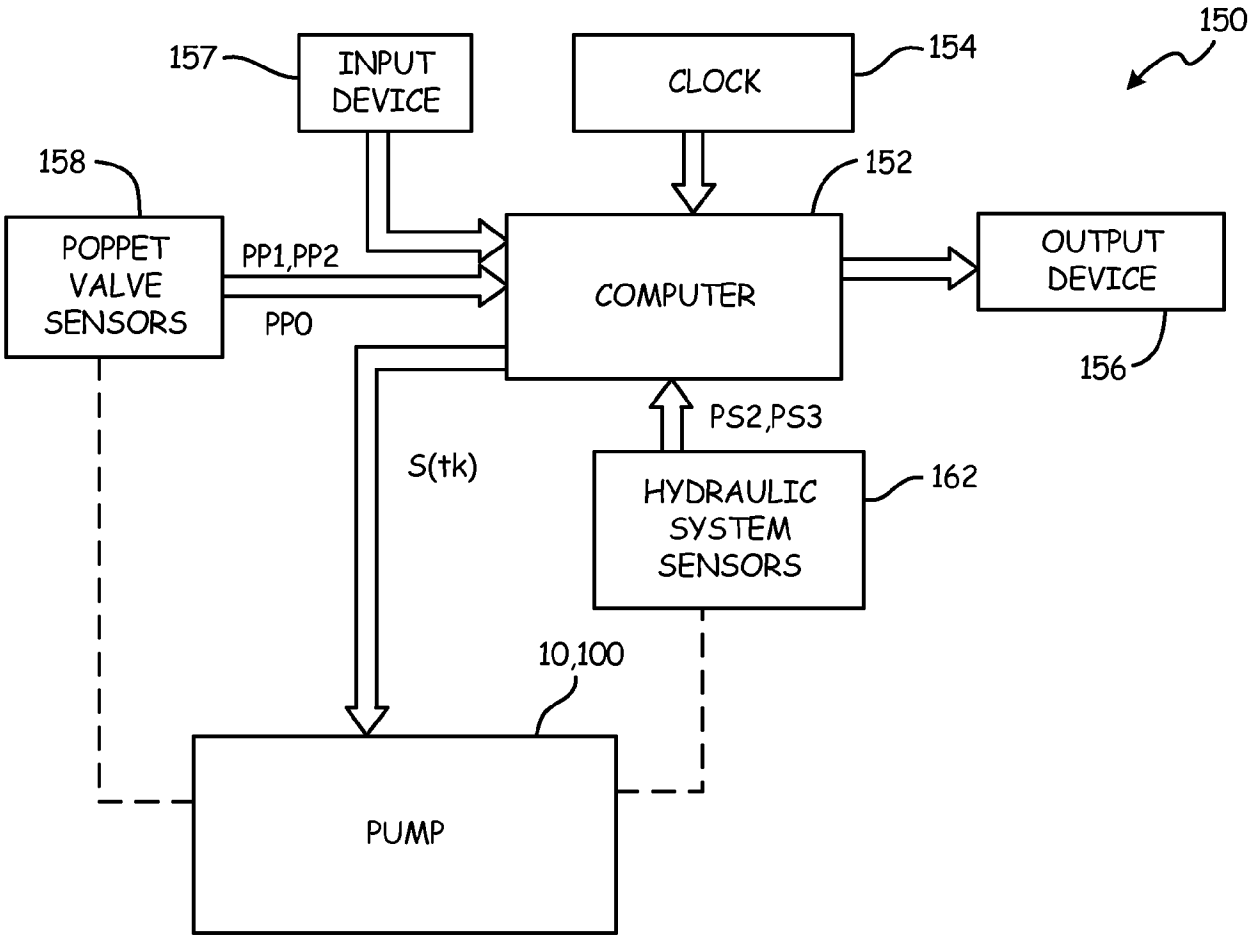
FIG. 3 is a block diagram of a monitoring system for measurement of filling efficiency and the determination of pump material volume.

FIG. 3 shows a block diagram of an embodiment of the present invention, in which operation of either pump 10 or pump 100 is monitored by system 150 to provide an accurate measurement of volume pumped on a cycle-by-cycle (stroke-by-stroke) basis, and on an accumulated basis. Monitor system 150 includes digital computer 152, which in a preferred embodiment is a microprocessor based computer including associated memory and input/output circuitry, clock 154, output device 156, input device 157, poppet valve sensors 158 (i.e., PP1 and PP2 in the case of pump 10 or PP0 in the case of pump 100), and hydraulic system sensors 162 (PS2 and PS3).

Clock 154 provides a time base for computer 152. Although shown separately in FIG. 4, clock 154 is, in preferred embodiments of the present invention, contained as a part of digital computer 152.

Output device 156 takes the form, for example, of a liquid crystal display, a printer, or communication devices which transmit the output of computer 152 to another computer based system (which may, for example, be monitoring the overall operation of the entire facility where sludge pump 10 is being used).

Sensors 158 and 162 monitor the operation of pump 10 and provide signals to computer 152. Signals PP1 and PP2 (or PP0) from sensors 158, signals S2, S3 from sensors 162, together with periodic piston speed command signals S(tk) (shown in FIGS. 4A-4C) provided by computer 152 to hydraulic swash plates of pump 10 or 100, are used to determine the percent fill of the cylinder during each pumping stroke of pump 10, 100. From this information, computer 152 can determine the volume of material pumped during that particular cycle, the accumulated volume, the pumping rate during that cycle, and an average pumping rate over a selected period of time. Computer 152 stores the data in memory, and also provides signals to output device 156 based upon the particular information selected by input device 157.

In one preferred embodiment of the present invention, the determination of volume pumped during a pumping cycle is achieved by accurately calculating fill percentage of sludge pump cylinder using hydraulic control valve switching, poppet valve switching, and the time-history of analog piston speed command signals during each pumping stroke.

Pump 10 (or 100) has an outlet valve 30, 32 (or 130) between the cylinders and the outlet which opens only when pressure within the cylinder overcomes pressure at the outlet. The opening of the outlet valve is sensed by the computer via poppet valve sensors PP1, PP2 (or PP0), and a quantity that is proportional to the distance traveled by the piston from its position when the outlet valve is opened to its position at the end of the stroke is determined by periodically recording the piston speed analog command signal at small fixed time intervals and summing the recorded command signal values. The value of this summation is compared to the value of a similarly obtained piston analog speed command summation recorded during the entire stroke. The ratio of these summations gives an accurate calculation of the filling efficiency of the stroke. This calculation is obtained without the use of a piston position sensor, hydraulic flow sensor, piston speed sensor, or the recording and use of the time of any sensed event. A significant advantage to this calculation method over other methods of determining filling efficiency is that the estimation is valid regardless of whether the piston speed changes mid-stroke provided that the speed command sample period is short enough to provide adequate resolution between measurements.

Figure 4A:
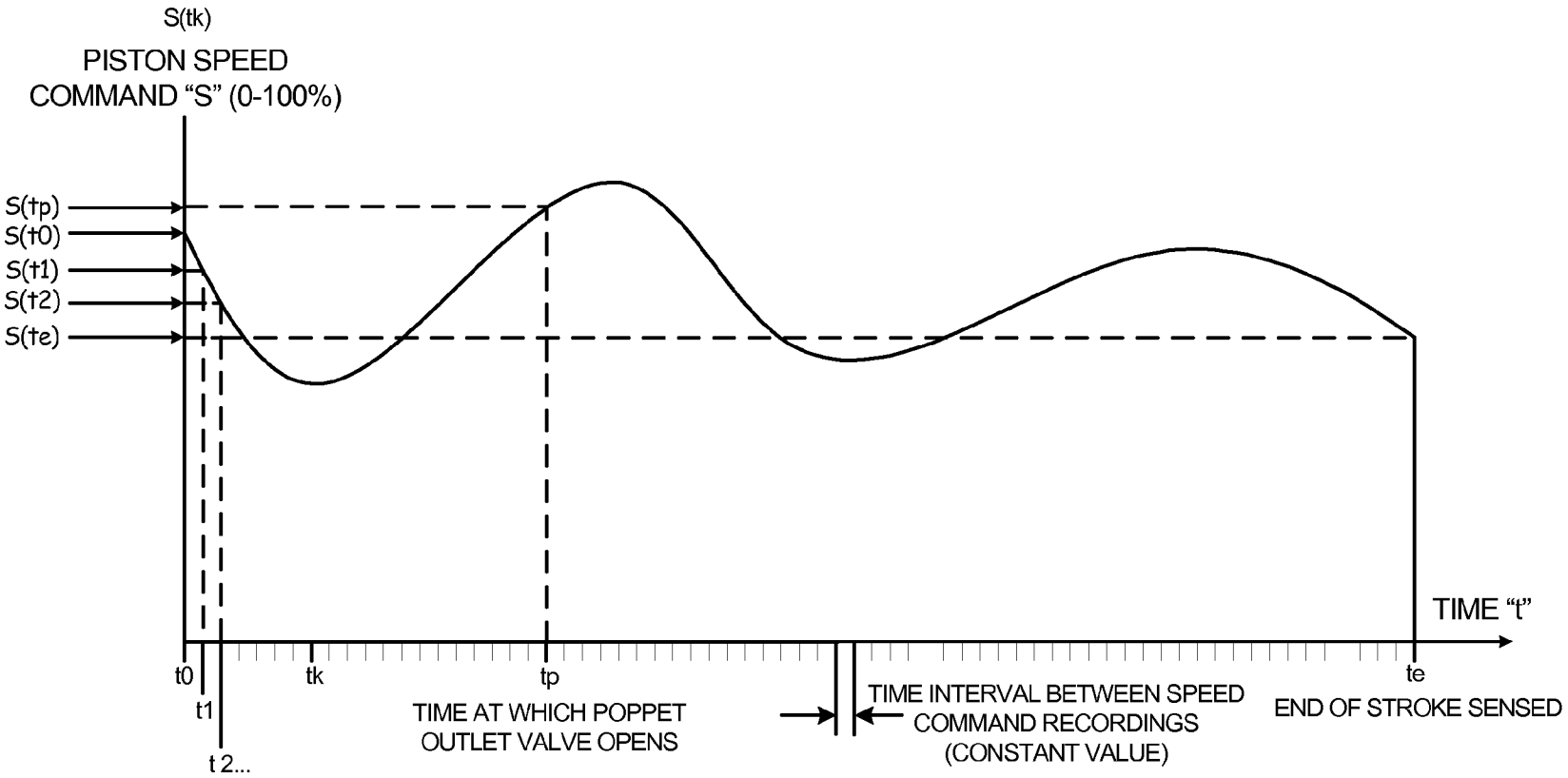
FIGS. 4A-4C illustrate sludge flow measurement based upon summations of periodic piston speed command values.
Figure 4B:
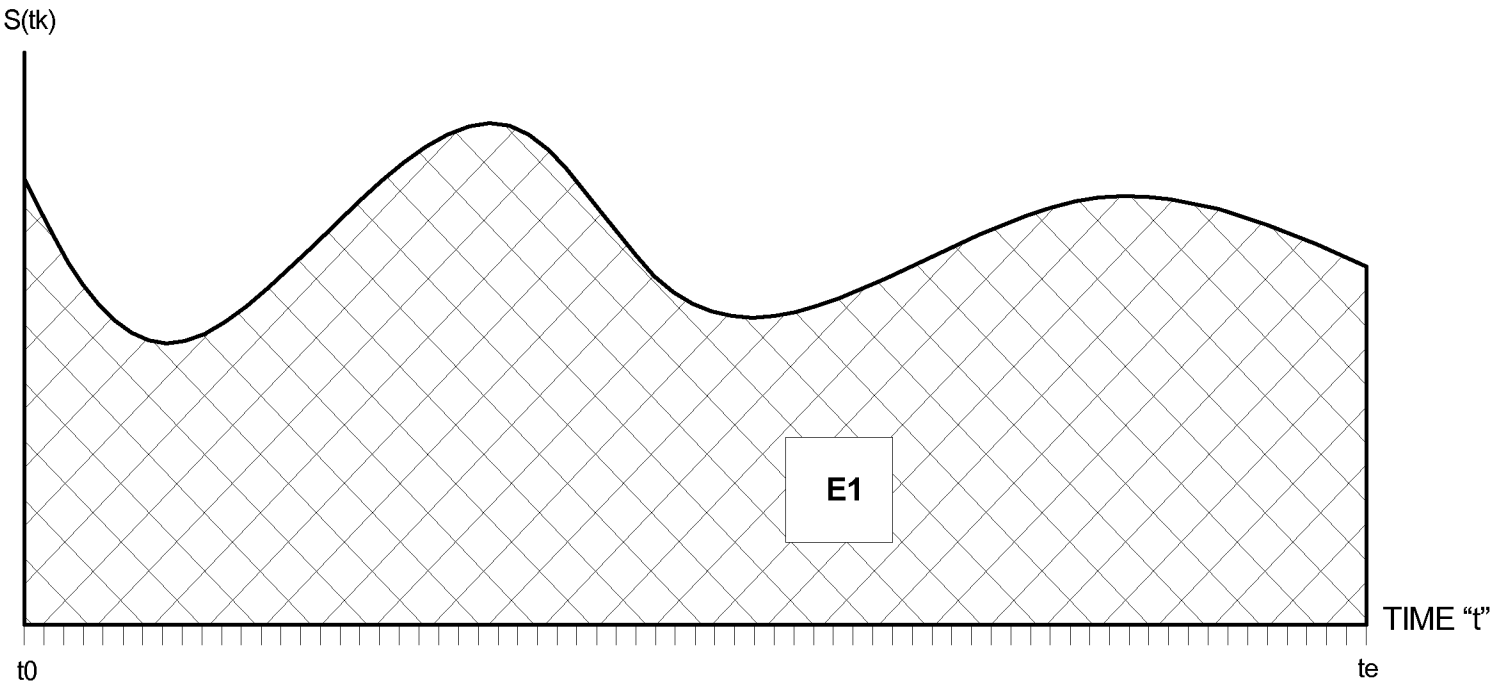
Figure 4C:
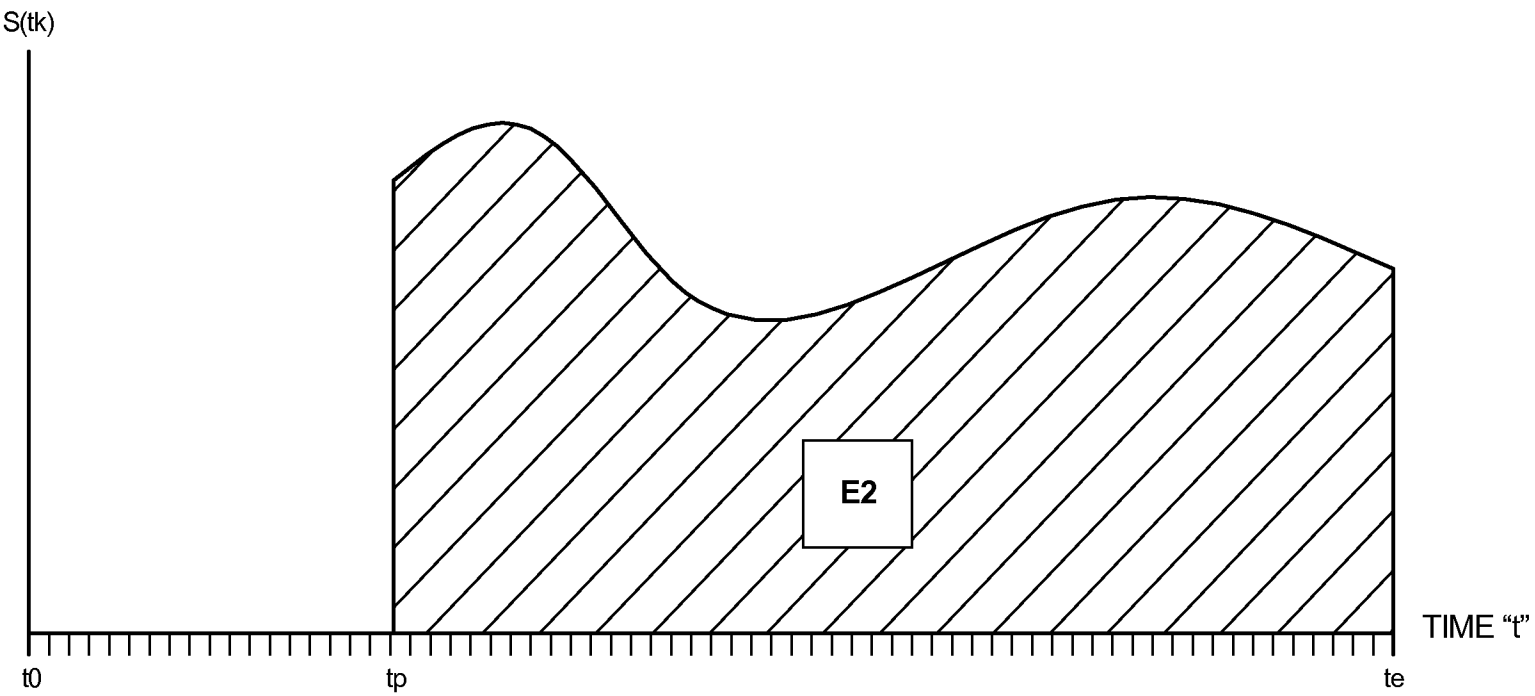

A hydraulic control valve proximity switch (PS2) provides indication to the computer of the start of a pumping stroke at time t0. Another hydraulic control valve proximity switch (PS3) indicates to the computer the end of the pumping stroke at time te. Poppet valve switches (PP1, PP2 or PP0) indicate the opening of the poppet outlet valves at time tp. At the beginning of the stroke, the computer begins periodically totalizing the piston speed command signals S(tk) it sends to the hydraulic swashplates, beginning with S(t0), adding to the summation the commanded speed value at each consecutive periodic time value tk. This summation (E1) finishes totalizing at the end of the stroke at time te. The computer begins totalizing a second periodic summation of speed commands (E2) when it senses the poppet outlet valve has opened at time tp, starting with S(tp), adding to this summation the commanded speed value at each consecutive periodic time value tk. This summation also finishes totalizing at the end of the stroke at time te. Assuming that the speed command signal is proportional to the actual speed of the piston, E1 is proportional to the entire stroke distance, and E2 is proportional to the distance traveled by the piston when the cylinder contents were fully compacted into the cylinder. This calculation method does not calculate or measure piston speed. Rather, it calculates a quantity that is proportional to piston speed. Similarly, piston position and distance are never calculated or measured, nor is any time value of any sensed event involved in the calculation. The time values mentioned above and in the diagram below (t0, tk, tp, te) are only illustrative of the process sequence and are not included in the efficiency calculation below. FIG. 4A shows the variation of speed command signals S(tk) as a function of time. FIG. 4B illustrates summation E1, and FIG. 4C illustrates summation E2.

The accuracy of this method is improved over time-based filling efficiency calculation methods which use poppet valve cylinder closing event as the start of the timed stroke event (t0). This is because this method uses the sensing of hydraulic control valve actuation, which correlates directly with piston presence at its end-of-travel, as indication of the start of a piston stroke. Time based systems using the poppet closing event to start the timer include poppet valve change-over time as part of the calculation, adding time to the clock that is not actually time spent stroking the pumping cylinder. This can artificially skew the time-based efficiency calculation.

$$D1 = \lambda * E1$$

$$D2 = \lambda * E2$$

$$\text{Filling Efficiency of Stroke} = \frac{D2}{D1} = \frac{\lambda * E2}{\lambda * E1} = \frac{E2}{E1}$$

Where:

$$E1 = \sum_{k=0}^{e} S(tk)$$

$$E2 = \sum_{k=p}^{e} S(tk)$$

$$D1 = \text{Whole Stroke Distance}$$

$$D2 = \text{Filled Cylinder Distance}$$

$$\lambda = \text{Proportionality Constant}$$

An alternative embodiment also calculates fill efficiency by recording speed command signals periodically from the start of the stroke to the end of the stroke and also periodically recording speed command signals from the opening of the poppet valve to the end of the stroke. For each of the two sets of recordings, an average speed command recording value is calculated. A1 is the average of the speed command values taken during the entire stroke, and A2 is the average of the speed command values taken after the poppet valve opened. A quantity that is proportional to the pump piston distance traveled from the piston position when the poppet valve opened to the piston position at the end of stroke, and a quantity that is proportional to the pump piston distance traveled from the beginning of the stroke to the end of the stroke can be determined by multiplying each average speed command quantity (A1 and A2) by the time duration over which the associated recordings were taken (ta and tb). The ratio of these quantities is equal to the filling efficiency of the piston stroke.

The time durations can be found in several ways. An independent timer can be used to time the duration of the whole stroke, starting timing at the stroke beginning event and ending timing at the stroke end event (this duration is ta). Similarly, an independent timer can be used to measure the duration of the stroke portion that occurred from the poppet valve opening event to the end of stroke event (this duration is tb). Alternately, ta and tb can be calculated by multiplying the time period between consecutive speed command recordings by the number of speed command recordings taken during the duration of each associated piston travel event.

$$D_1 = \lambda * A_1 * t_a$$

$$D_2 = \lambda * A_2 * t_b$$

$$\text{Filling Efficiency of Stroke} = \frac{D_2}{D_1} = \frac{\lambda * A_2 * t_b}{\lambda * A_1 * t_a} = \frac{A_2 * t_b}{A_1 * t_a}$$

Where:

$A_1$=Average Value of Speed Commands Taken During Entire Stroke $A_2$=Average Value of Speed Commands Taken During Filled Cylinder Portion of Stroke $D_1$=Whole Stroke Distance $D_2$=Filled Cylinder Distance $t_a$=Time Duration of Entire Stroke $t_b$=Time Duration of Filled Cylinder Portion of Stroke After Poppet Sensor has Opened λ=Proportionality Constant One benefit of the present invention is that it does not require an assumption that pump speed be constant from pump stroke to pump stroke, or even during a single pump stroke. Horsepower limitations can, in some cases, require that pump speed be varied during a single pump stroke. This has, in the past, been a source of inaccuracy in sludge flow measurement.

Another source of inaccuracy in the past was the use of poppet valves to define the beginning and end of a piston stroke, as well as defining when material began to flow out of the cylinder. Typically, the end of one pump stroke and the beginning of the next pump stroke was considered to be the same event because signals derived from the poppet valve could not distinguish between when the end of one piston stroke ended and the next piston stroke began. The time delay between those two events was not factored into the calculation, and therefore, the time duration of the piston stroke from beginning to end was actually shorter than the time derived from opening and closing of poppet valves.

Other embodiments make use of sensing $t_o$ and $t_e$ with hydraulic sensors (PS2, PS3) and start of material flow with poppet valve sensors (PP1, PP2, or PP0), but use a parameter other than periodic piston speed commands. Examples of other embodiments include:

(1) Measuring the amount of oil displaced by the hydraulic pump as the volume of the hydraulic cylinder of the piston pump is a known volume. Oil displaced by pump between tp and te will yield filling efficiency.

(2) Using a hydraulic cylinder with a linear position indicator to monitor location of hydraulic cylinder when tp occurs (3) Using a predictive speed method as from point t0 to tp the velocity of the hydraulic cylinder will be constant as it has not encountered pipeline pressure resistance yet. Knowing t0 to tp and knowing what the predicted time to complete a pumping stroke is based on the commanded speed will yield the filling efficiency.

(4) Using time based measurement if the stroke speed is determined based on the operating pressure at the end of each pumping stroke and is held constant over the next complete pumping stroke. Pumping rate adjustments can be made only at the completion of each pumping stroke.

(5) Similar to (1) above, a flow meter can be installed in the hydraulic system to measure the flow of oil directly into each hydraulic cylinder to eliminate error caused by (1) through hydraulic losses internal to the system. In other words, the hydraulic pump may be commanded to operate the pump at a certain speed, but oil leakage internal to the system may prevent the pump from operating at the commanded speed.

In these alternative embodiments, accuracy is improved as the time the poppets take to shift is eliminated from the calculation. This time was included in the original invention and constituted a varying amount of error based on the pumping speed.

Additionally, three poppets change position at te, but the discharge poppet will be held closed until time tp, at which time this poppet takes oil from the pumping speed. This oil is a fixed volume so a constant can be introduced into these calculations to further eliminate this error from the calculation. This would not apply to alternatives (2), (3), and (5).

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of monitoring operation of a positive displacement piston/cylinder sludge pump driven by a hydraulic drive and having an inlet for receiving sludge material and an outlet at which sludge material is delivered, the method comprising:

sensing when a hydraulic drive starts a pumping stroke of the pump;

sensing when, during the pumping stroke of the pump, the sludge material begins to flow out of a cylinder;

sensing when the hydraulic drive ends the pumping stroke;

periodically recording piston speed command signals provided by a computer to the hydraulic drive to control operation of the pump, wherein the piston speed command signals are recorded at fixed time intervals to produce a first set of periodic piston speed command data during a whole stroke period defined by when the hydraulic drive starts and ends the pumping stroke;

periodically recording piston speed command signals provided by the computer to the hydraulic drive to control operation of the pump, wherein the piston speed command signals are recorded at fixed time intervals to produce a second set of periodic piston speed command data during a filled stroke period defined by when sludge material begins to flow out of the cylinder and when the hydraulic drive ends the pumping stroke;

determining an output value based upon the first set of periodic piston speed command data and the second set of periodic piston speed command data; and transmitting the output value to an output device that reports the output value;

wherein output data is determined and transmitted by the computer.

2. The method of claim 1, wherein determining an output value comprises:

producing a first summation of the first set of periodic piston speed command data collected during the whole stroke period;

producing a second summation of the second set of periodic piston speed command data collected during the filled stroke period; and producing a fill efficiency value based upon the first summation and the second summation.

3. The method of claim 2, wherein the output value is based upon the fill efficiency value.

4. The method of claim 3, wherein the output value represents an actual volume of sludge material delivered by the pump during a pumping stroke.

5. The method of claim 3, wherein the output value represents an accumulated volume of sludge material delivered by the pump during a plurality of pumping cycles.

6. The method of claim 3, wherein the output value represents flow rate of sludge material delivered by the pump.

7. The method of claim 1, wherein determining an output value comprises:

producing a first average piston speed command value based on the first set of periodic piston speed command data collected during the whole stroke period;

producing a second average speed command value based on the second set of periodic piston speed command data collected during the filled stroke period; and producing a fill efficiency value based upon the first average piston speed command value and the second average piston speed command value.

8. A pump system for pumping sludge material, the pump system comprising:

a positive displacement pump which includes:

an inlet for receiving sludge material which contains solids, liquids, and gases and which is partially compressible such that a reduction in volume of sludge material occurs when sludge material is placed under pressure in the pump system;

an outlet at which sludge material is delivered under pressure;

a cylinder;

a piston movable in the cylinder;

hydraulic drive system for moving the piston reciprocatively through a cycle which includes a pumping stroke and a filling stroke; and a valve system for connecting the cylinder to the outlet during the pumping stroke and connecting the cylinder to the inlet during the filling stroke;

hydraulic system sensors for providing a first signal that indicates when a pump stroke begins and a second signal that indicates when a piston stroke ends;

a poppet valve sensor for providing a third signal which indicates when sludge material begins to flow from the cylinder at a time following the beginning of the piston movement during the pumping stroke; and a computer for providing piston speed command signals to the hydraulic drive system to control operation of the pump and for determining an output value related to fill efficiency, wherein the computer periodically records piston speed command signals at fixed time intervals to produce a first set of periodical piston speed command data during a whole stroke period defined by the first and second signals and to produce a second set of periodic speed command data during a filled stroke period defined by the third and second signals, and wherein the computer determines the output value based upon the first set of periodic piston speed command data and the second set of piston speed command data and transmits the output value to an output device that reports the output value.

9. The system of claim 8, wherein the output value represents an actual volume of sludge material delivered by the pump during a pumping stroke.

10. The system of claim 8, wherein the output value represents an accumulated volume of sludge material delivered by the pump during a plurality of pumping strokes.

11. The system of claim 8, wherein the output value represents flow rate of sludge material delivered by the pump.

12. The system of claim 8, wherein the computer produces a first summation of the first set of periodic piston speed command data collected during a whole stroke period defined by the first and second signals, and a second summation of the second set of periodic piston speed command data collected during a filled stroke period defined by the third and second signals, and wherein the computer produces the output value based on the first summation and the second summation.

13. The system of claim 8, wherein the computer produces a first average of the first set of periodic piston speed command data collected during a whole stroke period defined by the second set of first and second signals and a second average of the periodic piston speed command data collected during a filled stroke period defined by the second and third signals, and wherein the computer produces the output value based on the first average and the second average.

14. A method of monitoring operation of a positive displacement piston/cylinder sludge pump driven by a hydraulic drive, the method comprising:

sensing a fill percentage of a cylinder based upon a first signal indicating when the hydraulic drive begins a pump stroke, a second signal indicating when the hydraulic drive ends the pump stroke, and a third signal indicating when sludge material begins to flow out of the cylinder during the pumping stroke;

determining an output value based on the fill percentage of the cylinder when sludge material begins to flow out of the cylinder after piston movement begins; and providing an output signal as a function of the output value; wherein sensing a fill percentage includes periodically recording piston speed command signals provided by a computer to the hydraulic drive to control operation of the pump, wherein the piston speed command signals are recorded at fixed time intervals to produce a first set of periodic piston speed command data during a whole stroke period defined by the first and second signals and a second set of periodic speed command data during a filled stroke period defined by the third signal and the second signal;

transmitting the output value to an output device that reports the output value;

wherein output data is determined and transmitted by the computer.

15. The method of claim 14 wherein the output value represents an actual volume of sludge material delivered by the pump during a pumping stroke.

16. The method of claim 14 wherein the output value represents an accumulated volume of sludge material delivered by the pump during a plurality of pumping strokes.

17. The method of claim 14 wherein the output value represents flow rate of sludge material delivered by the pump.

18. The method of claim 14 wherein sensing the fill percentage includes producing a first summation of the first set of periodic piston speed command data during a whole stroke period defined by the first and second signals, and a second summation of the second set of periodic piston speed command data during a filled stroke period defined by the third signal and second signal.

19. The method of claim 14 wherein sensing the fill percentage includes producing a first average piston speed command value based on the first set of periodic piston speed command data collected during a whole stroke period defined by the first and second signals, and a second average piston speed command value based on the second set of periodic piston speed command data collected during a filled stroke period defined by the third signal and the second signal.

* * * * *